US008696385B2

(12) United States Patent
Wu

(10) Patent No.: US 8,696,385 B2
(45) Date of Patent: Apr. 15, 2014

(54) CABLE CONNECTOR ASSEMBLY HAVING A FRONT SHELL AND A REAR SHELL WITH INTERLATCHING PARTS

(75) Inventor: Jerry Wu, Irvine, CA (US)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 10 days.

(21) Appl. No.: 13/571,371

(22) Filed: Aug. 10, 2012

(65) Prior Publication Data

US 2013/0040493 A1 Feb. 14, 2013

(30) Foreign Application Priority Data

Aug. 10, 2011 (CN) ..... 2011 1 0228379

(51) Int. Cl.
*H01R 13/648* (2006.01)

(52) U.S. Cl.
USPC ..... 439/607.56

(58) Field of Classification Search
USPC ..... 439/607.54–607.56, 607.23–607.25, 439/607.41
See application file for complete search history.

(56) References Cited

U.S. PATENT DOCUMENTS

| | | | | |
|---|---|---|---|---|
| 6,383,024 | B1 * | 5/2002 | Wang et al. | 439/607.23 |
| 7,690,948 | B2 * | 4/2010 | Lung | 439/607.27 |
| 8,142,226 | B2 | 3/2012 | Xiao et al. | |
| 8,303,344 | B2 * | 11/2012 | Xiao et al. | 439/607.56 |
| 8,500,494 | B2 * | 8/2013 | Wu | 439/660 |
| 2010/0112863 | A1 * | 5/2010 | Xiao et al. | 439/607.27 |
| 2010/0158449 | A1 * | 6/2010 | Yi | 385/75 |
| 2011/0207371 | A1 * | 8/2011 | Tung et al. | 439/607.01 |
| 2011/0256773 | A1 * | 10/2011 | Hsu et al. | 439/626 |

* cited by examiner

*Primary Examiner* — Chandrika Prasad
(74) *Attorney, Agent, or Firm* — Wei Te Chung; Ming Chieh Chang

(57) ABSTRACT

A cable connector assembly (100) comprises an insulative housing (1) including a base portion and a first tongue and a second tongue extending forwardly from the base portion, a number of contacts (2) received in the insulative housing and held in the first and second tongues, and a metallic shell (3) enclosing the insulative housing. The metallic shell comprises a front shell (31) and a rear shell (32) combined with each other. The front shell has a front sleeve portion, a rear engaging portion (312) extending backwards from the sleeve portion, and a pair of arm portions extending rearwards from two sides of the engaging portion and opposite to each other. The rear shell encloses the engaging portion of the front shell, and has a latching hole (3212) on each of two lateral walls thereof engaging with a corresponding arm portion.

20 Claims, 8 Drawing Sheets

CABLE CONNECTOR ASSEMBLY HAVING A FRONT SHELL AND A REAR SHELL WITH INTERLATCHING PARTS

CROSS-REFERENCE TO RELATED APPLICATION

This application is related to U.S. patent application Ser. No. 13/470,552 filed on 2012 Dec. 14 and entitled "CABLE CONNECTOR ASSEMBLY WITH AN IMPROVED SHELL," which has the same applicant and assignee as the present invention.

BACKGROUND OF THE INVENTION

1. Field of the Invention

The present invention generally relates to a cable connector assembly, and more particularly to a cable connector assembly for high speed signal transmission.

2. Description of Related Art

U.S. Pat. No. 8,142,226 issued to Xiao on Mar. 27, 2012 discloses a cable connector assembly in accordance with USB 3.0 standard, the cable connector assembly comprises an insulative housing, a plurality of contacts received in the insulative housing, a metallic shell enclosing the insulative housing, and a pair of latches retained in the insulative housing and exposed out of the metallic shell. Tail portions of the contacts are extending beyond a rear end of the insulative housing to be electrically connected with a cable.

The metallic shell of the cable connector assembly comprises a two-piece configuration along an up-to-down direction in order to crimp the cable and shield an electrical connection between the cable and the contacts. However, the cable connector assembly with two pieces configuration may have a greater height and it is necessary to assemble the two pieces members along the up-to-down direction to form a complete shielding member.

Hence, it is desirable to have an improved shell structure for cable connector assembly.

BRIEF SUMMARY OF THE INVENTION

Accordingly, the object of the present invention is to provide a cable connector assembly with an improved shell.

In order to achieve the above-mentioned object, a cable connector assembly comprises an insulative housing including a base portion and a first tongue and a second tongue extending forwardly from the base portion, a plurality of contacts received in the insulative housing and held in the first tongue and the second tongue, and a metallic shell enclosing the insulative housing. The metallic shell comprises a front shell and a rear shell combined with each other. The front shell has a front sleeve portion, a rear engaging portion extending backwards from the sleeve portion, and a pair of arm portions extending rearwards from two sides of the engaging portion and opposite to each other. The rear shell encloses the engaging portion of the front shell, and the rear shell has a latching hole on each of two lateral walls thereof engaging with a corresponding arm portion.

Other objects, advantages and novel features of the invention will become more apparent from the following detailed description of the present embodiment when taken in conjunction with the accompanying drawings.

DETAILED DESCRIPTION OF THE INVENTION

Figure 1:
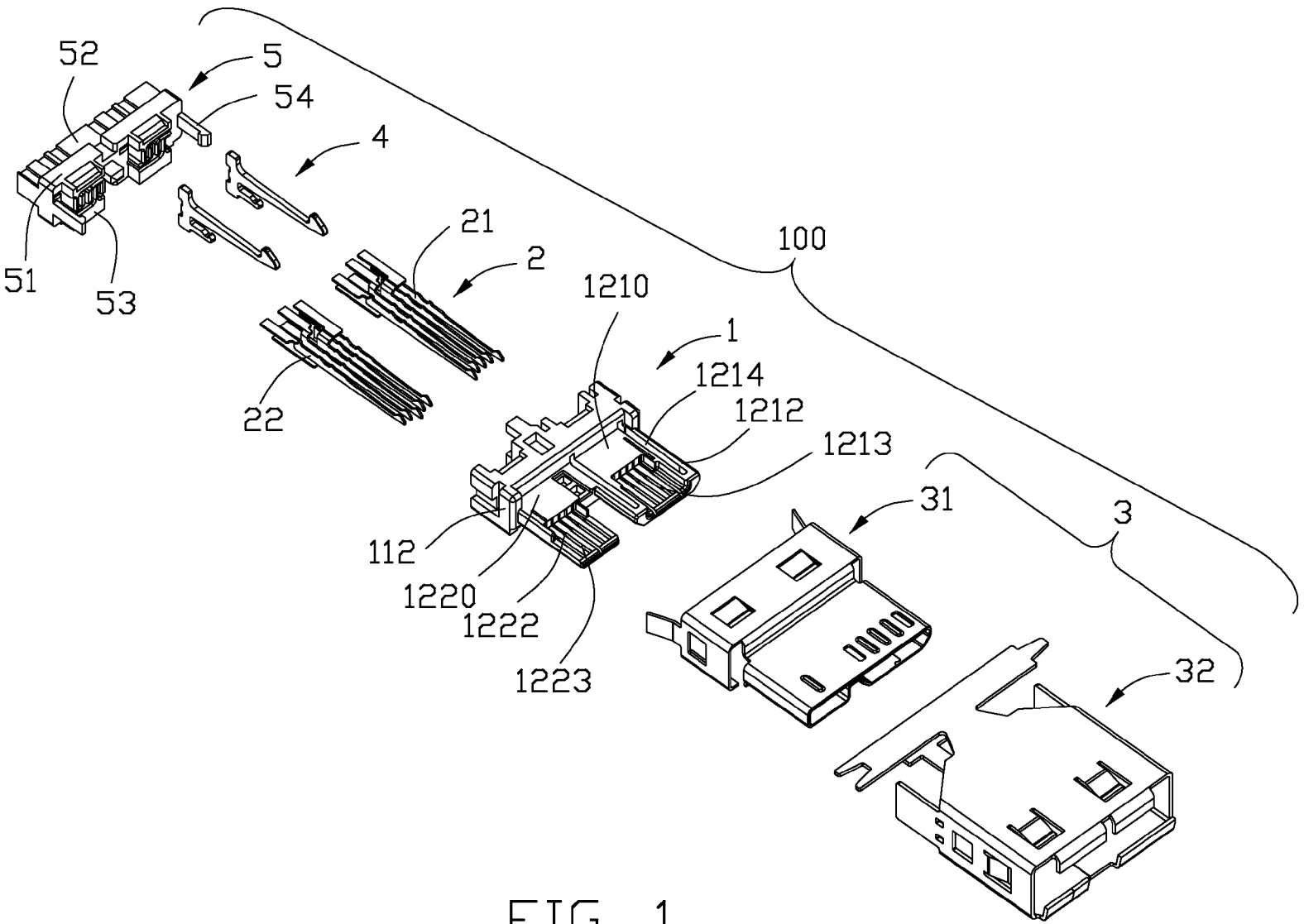
FIG. 1 is an exploded, perspective view of a cable connector assembly in accordance with the present invention.

Reference will now be made to the drawing figures to describe the present invention in detail.

Figure 2:
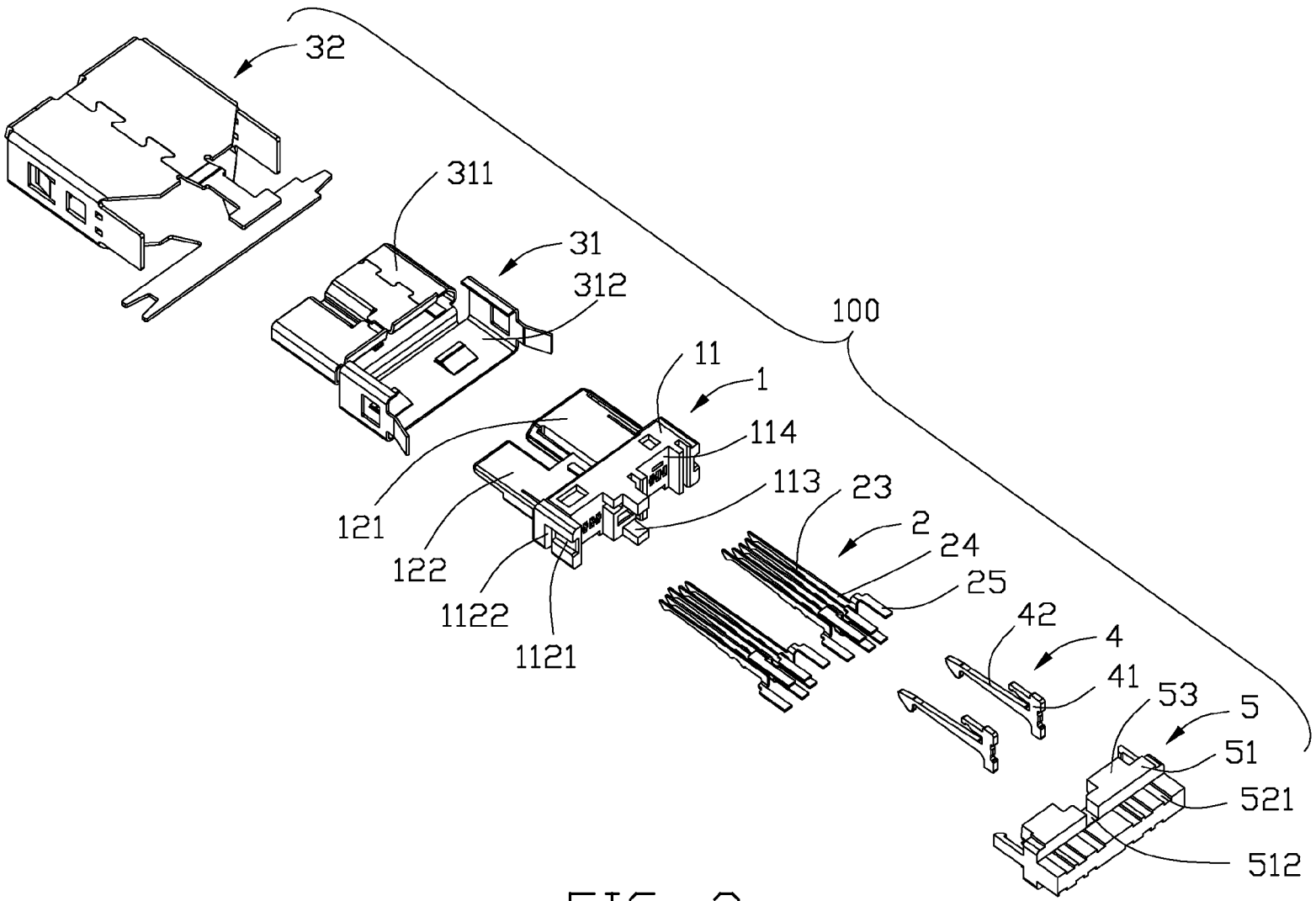
FIGS. 2-3 are views similar to FIG. 1, but viewed from different angles.
Figure 3:
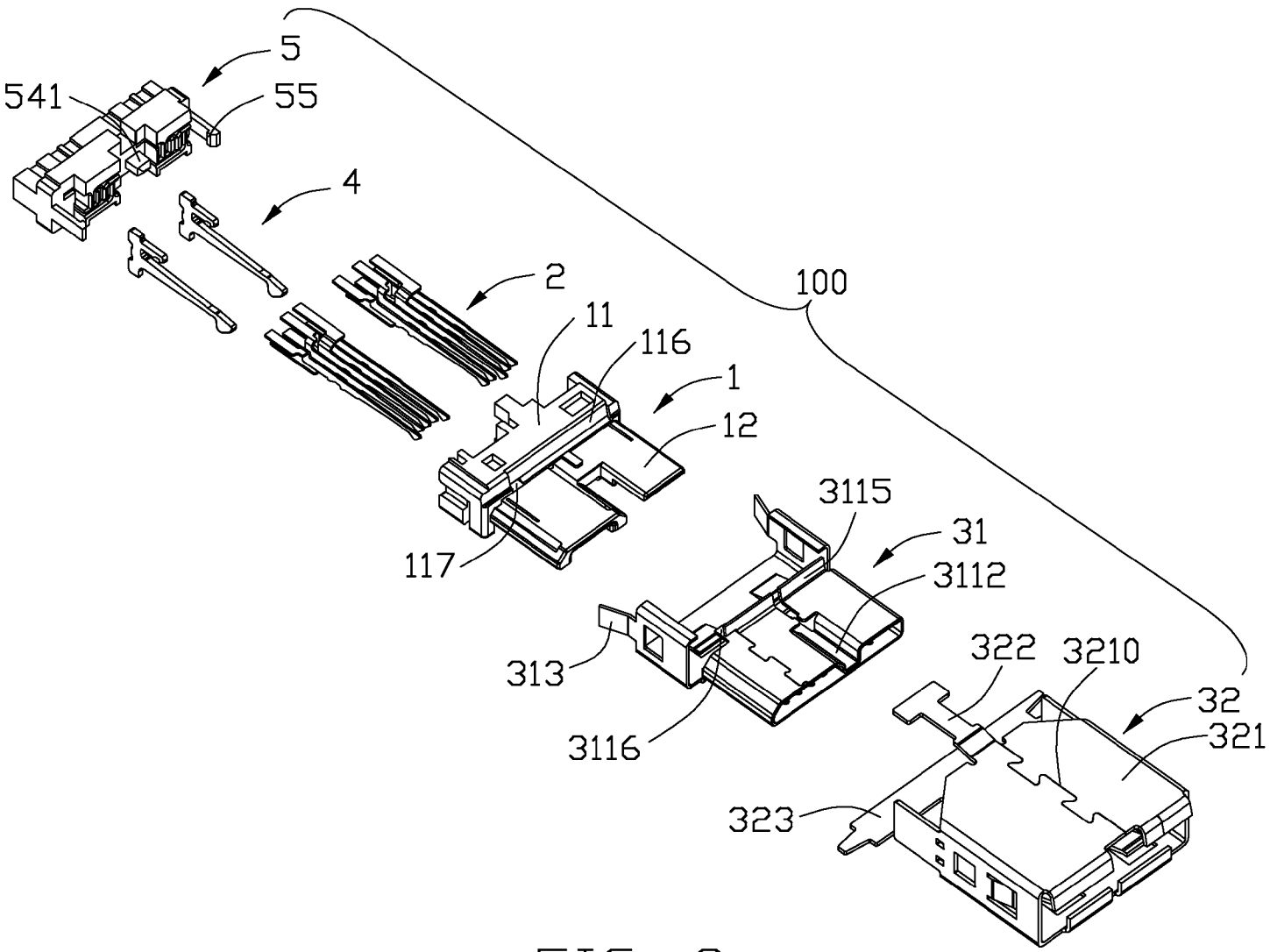
Figure 4:
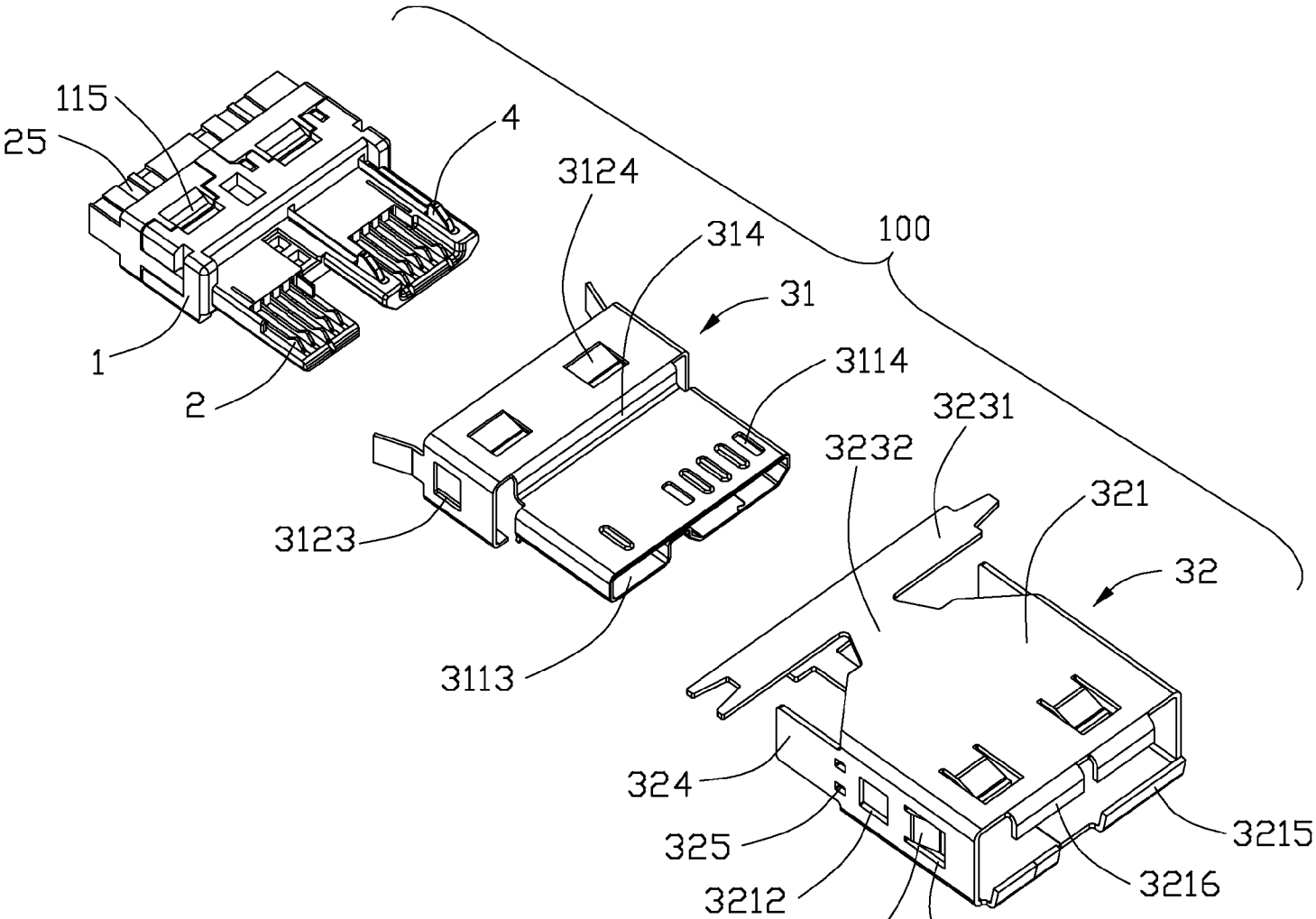
FIG. 4 is a partially assembled, perspective view of the cable connector assembly shown in FIG. 1.
Figure 5:
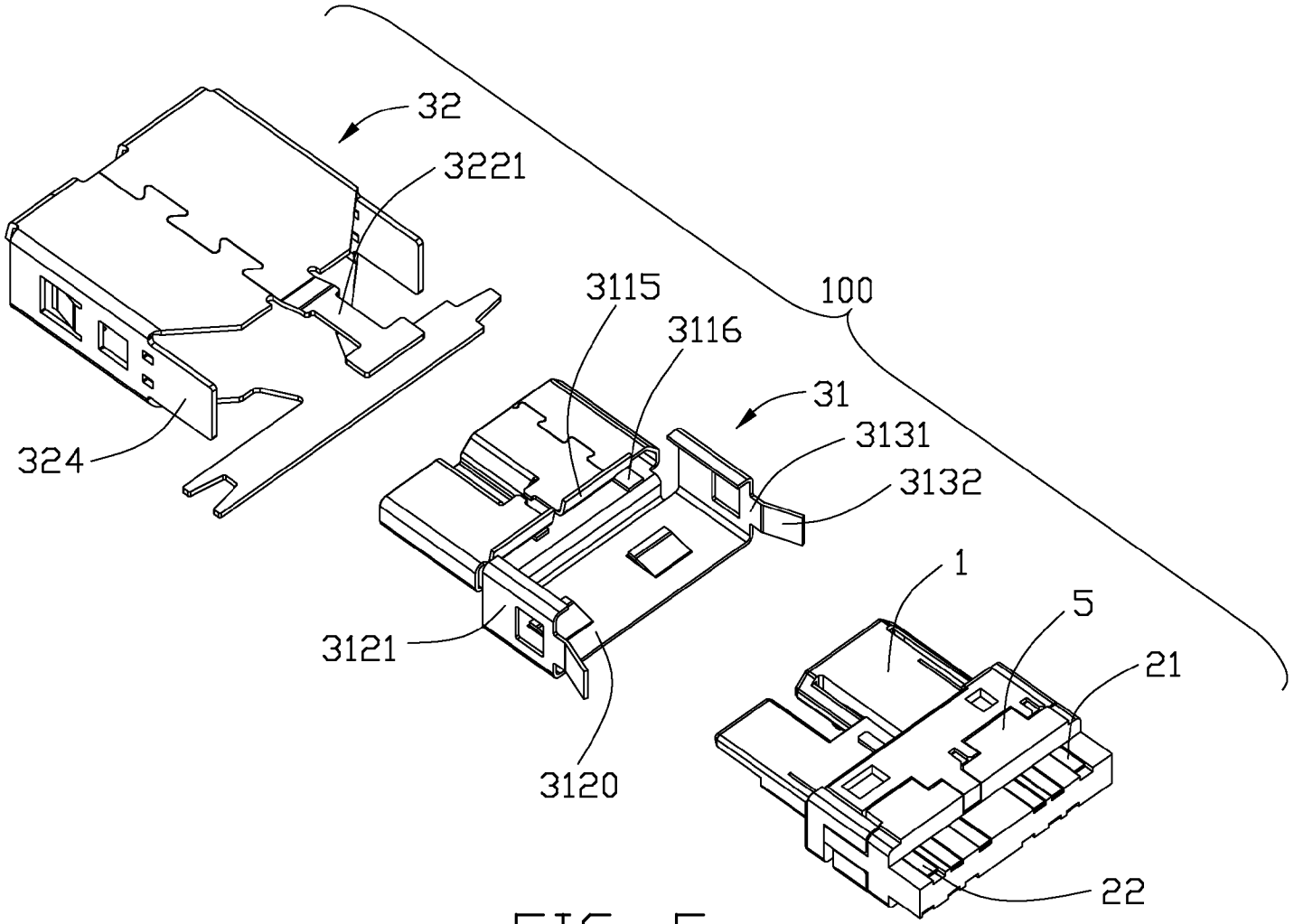
FIG. 5 is a view similar to FIG. 4, but viewed from a different aspect.

Referring to FIGS. 1-5, a cable connector assembly 100 made in accordance with the present invention comprises an insualtive housing 1, a plurality of contacts 2 held in the insulative housing 1, a metallic shell 3 enclosing the insualtive housing 1, a pair of latches 4 retained in the insulative housing 1 and exposed out of the metallic shell 3, and a spacer 5 fastened to the insulative housing 1 to support contacts 2.

Figure 6:
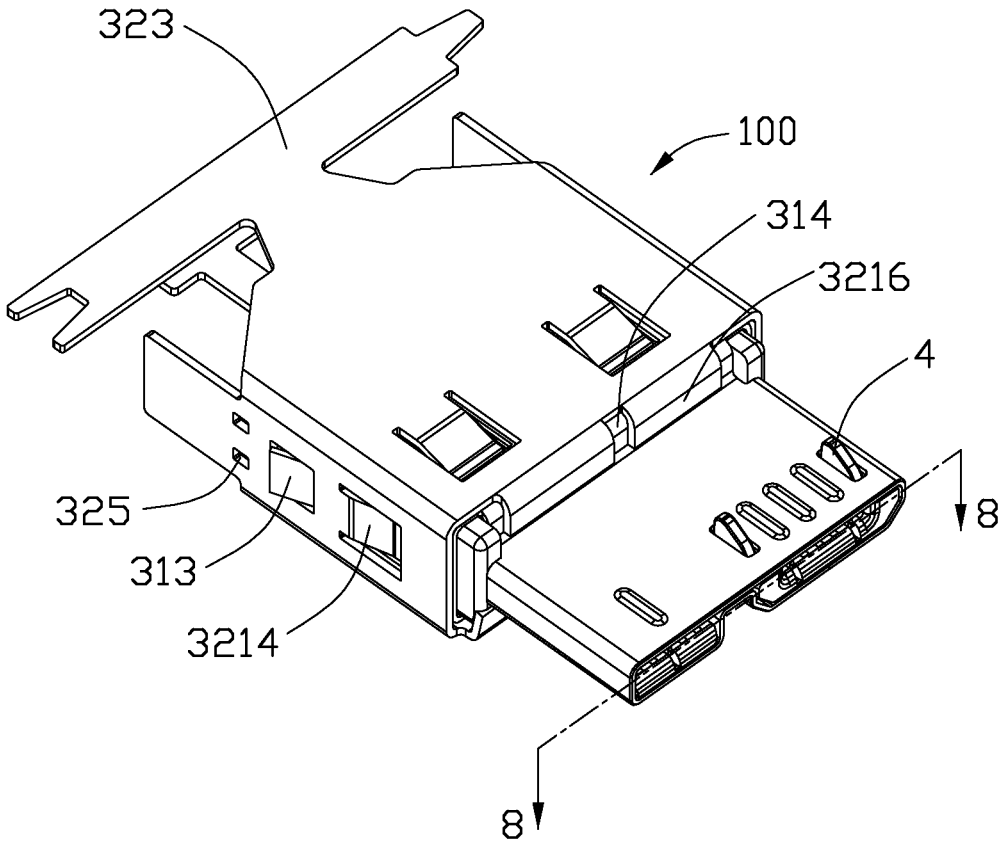
FIG. 6 is a further assembled, perspective view of the cable connector assembly shown in FIG. 4.
Figure 7:
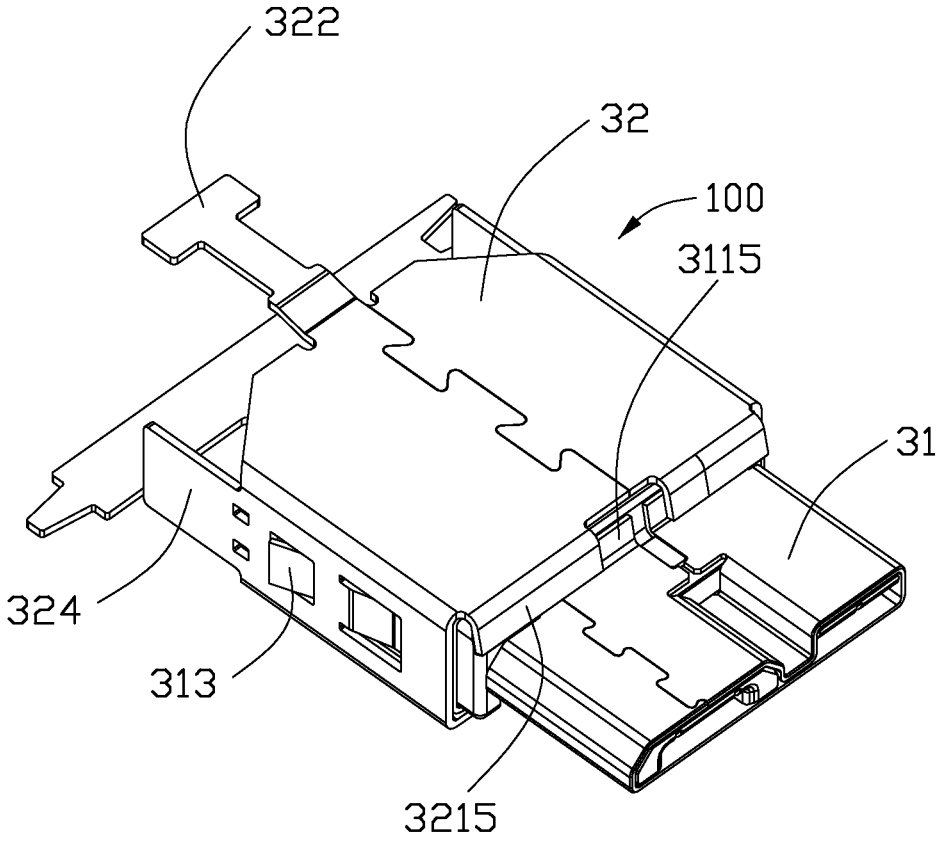
FIG. 7 is a view similar to FIG. 6, but viewed from a different angle.
Figure 8:
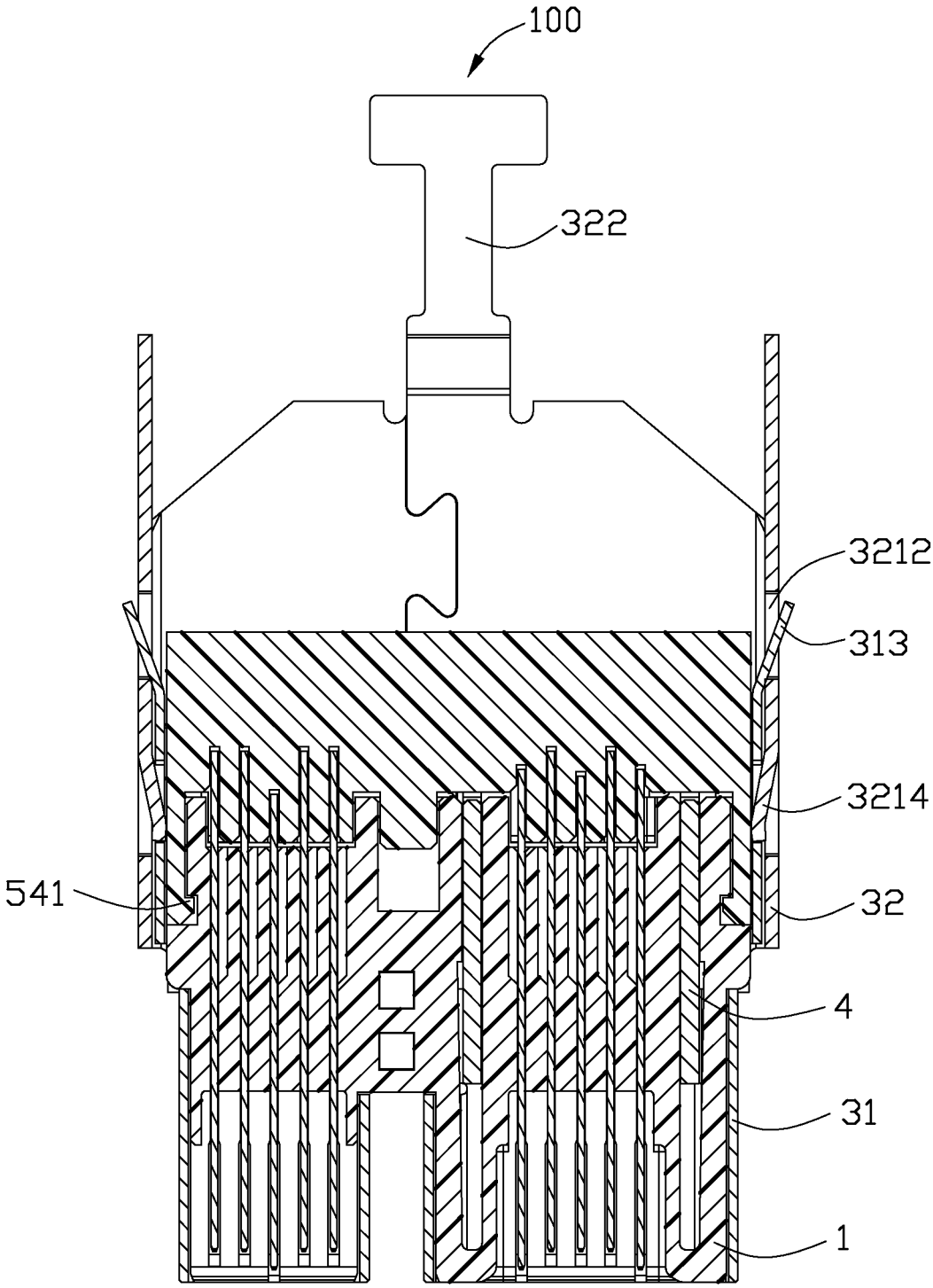
FIG. 8 is a cross-section view taken along line 8-8 of FIG. 6.

Referring to FIGS. 1-8, the insulative housing 1 includes a base portion 11 and a tongue portion 12 integrally extending forwardly beyond the base portion 11. The tongue portion 12 is split into a first tongue 121 and a second tongue 122 side by side arranged with each other and disposed in a common plane. The first tongue 121 is wider than the second tongue 122. The base portion 11 has a pair of lateral walls 112 opposite to each other, and each lateral wall 112 defines a first slot 1121 along a mating direction and a second slot 1122 perpendicular to the first slot 1121. The second slot 1122 is communicated with the first slot 1121 and deeper than the first slot 1121. The base portion 11 defines a pair of tabs 113 protruding rearwards from a back end thereof, and the two tabs 113 are arranged opposite to each other along a direction perpendicular to the mating direction. The base portion 11 defines a pair of outlets 114 recessed forwardly from the back end thereof. A vertical wall 116 is arranged on a conjunction area between the base portion 11 and the tongue portion 12, and the vertical wall 116 is recessed backwards with a certain distance. A positioning hole 117 is recessed backwards from the vertical wall 116, and the positioning hole 117 is located on one side of the vertical wall 116.

The first tongue 121 and the second tongue 122 are located on a same horizontal level, to make sure the cable connector assembly 100 with a low profile, and the size of the first tongue 121 is accordance with USB 2.0 standard. The first tongue 121 has a first rear segment 1210 mechanically connected with the base portion 11 and a first front segment 1212 away from the base portion 11. Relative to the first tongue 121, the second tongue 122 defines a second rear segment 1220 and a second front segment 1222. The first rear segment 1210 and the second rear segment 1220 are of a unitary configuration to make the tongue portion 12 stable, and the first front segment 1212 and the second front segment 1222 are spaced apart from each other to form two independent mating ports.

The first tongue 121 defines a plurality of first passages 1213 parallel to each other, the first passages 1213 are extending along the mating direction, and extending through the base portion 11. A pair of channels 1214 are defined on lateral sides of the first passages 1213 to receive the latches 4, and the channels 1214 are extending through the base portion 11.

Similar to the first tongue 121, the second tongue 122 defines a number of second passages 1223 parallel to the first passages 1213, and the second passages 1223 are extending through the base portion 11.

The contacts 2 include a plurality of first contacts 21 and a plurality of second contacts 22, and the first contacts 21 are received in the corresponding first passages 1213 with the second contacts 22 received in the corresponding second passages 1223. The first contacts 21 are compatible to version 2.0 Micro Universal Serial Bus. Each contact 2 comprises a contacting portion 23 extending along the mating direction, a retaining portion 24 extending rearwards from the contacting portion 23, and a tail portion 25 bent downwards or upwards from the retaining portion 24. The tail portion 25 is located in a horizontal plane.

The second contacts 22 include five conductive contacts, and the middle one of the second contacts 22 is a grounding contact, a pair of signal contact for transmitting high speed signal and a pair of signal contacts for receiving high speed signal are located on both sides of the grounding contact. The grounding contact has a pair of soldering portions on an upper side and a lower side of a rear section.

The first contacts 21 also include five conductive contacts, and the middle one of the first contacts 21 is a signal contact, the signal contact of the first contacts 21 and the grounding contact of the second contacts 22 have the same configuration with each other, so the first contacts 21 have six soldering portions arranged on two levels for preventing cross-talk.

The metallic shell 3 includes a front shell 31 and an rear shell 32 combined with each other. The front shell 31 comprises a sleeve portion 311 in the front thereof, an engaging portion 312 extending rearwards from the sleeve portion 311, and a pair of arm portions 313 extending rearwards from both sides of the engaging portion 312. A vertical conjoining wall 314 is defined on a conjunction area between the engaging portion 312 and the sleeve portion 311.

The sleeve portion 311 defines a depression 3112 relative to a gap between the first front segment 1212 and the second front segment 1222, and the depression 3112 is divided the sleeve portion 311 into two mating cavities 3113 for receiving the first tongue 121 and the second tongue 122. The sleeve portion 311 defines a pair of notches 3114 receiving the latches 4. The sleeve portion 311 defines a pair of stopping portions 3115 bent upwards from a back free end thereof, the stopping portions 3115 are located on a boundary between the sleeve portion 311 and the engaging portion 312, and arranged along a vertical direction. A horizontal extrusion portion 3116 is extending backwards from the back end of the sleeve portion 311, the extrusion portion 3116 is located on one side of the stopping portions 3115 and crossed perpendicularly with the neighboring stopping portion 3115.

The engaging portion 312 is of U-shape, and comprises a bottom wall 3120 and a pair of side walls 3121 connected with the bottom wall 3120, each side wall 3121 defines a locking hole 3123, and the arm portions 313 extends backwards from corresponding side walls 3121. A pair of elastic portions 3124 are defined on the bottom wall 3120. The arm portions 313 are opposite to each other, and each arm portion 313 includes a straight portion 3131 extending along the mating direction and an expansion portion 3132 extending backwards and outwards from the straight portion 3131.

The rear shell 32 comprises a main body 321 with a tube shape, the main body 321 has a joining line 3210 on an upper wall thereof. The main body 321 defines a latching hole 3212 on each lateral wall thereof, and an outlet 3213 is disposed in front of the latching hole 3212, a fastener 3214 is defined in the outlet 3213 and bent inwards from a rear wall of the outlet 3213, thus a back end of the fastener 3214 is connected with the rear wall of the outlet 3213. The main body 321 defines a pair of upper flanges 3215 and a pair of lower flanges 3216 on a front end thereof, and the two upper flanges 3215 has a larger distance therebetween than the two lower flanges 3216.

The rear shell 32 defines a continued portion 322 extending backwards from an upper surface thereof, and a fixing portion 323 opposite to the continued portion 322. The continued portion 322 is of T-shape, and has a larger length than the fixing portion 323 along the mating direction. A pair of cutouts 3221 are formed on both sides of the continued portion 322, and the cutouts 3221 are opposite to each other and neighboring to a free end of the continued portion 322. The fixing portion 323 has a clipping portion 3232 on a free end thereof, and the clipping portion 3232 extends along a transverse direction. The clipping portion 3232 is connected with the conjoint portion 321 via a linking portion 3231 extending along the mating direction, and opposite ends of the clipping portion 3232 are bent towards each other to clamp a cable (not shown). In the preferred embodiment, the linking portion 3231 has a horizontal cross-section view with a trapezoid shape, and the linking portion 3231 also can have other shapes in other embodiments.

The main body 321 defines a pair of shielding portions 324 extending rearwards from lateral sides thereof, the shielding portions 324 are opposite to each other. A plurality of through holes 325 are disposed on a conjunction area of each shielding portion 324 and the main body 321, and the through holes 325 on a same side are arranged along a vertical direction. The latching hole 3212 of the main body 321 is located in front of and neighboring to the corresponding holes 325.

Each latch 4 comprises a retaining standoff 41 held in the base portion 11 of the insulative housing 1 and an engaging arm 42 extending forwards from the retaining standoff 41, the engaging arm 42 is received in the relative channel 1214 of the insulative housing 1.

The spacer 5 is made of insulative material, and comprises a primary portion 51, an extension portion 52 extending backwards from a rear end of the primary portion 51, a pair of rectangular protrusions 53 extending forwards from a front end of the primary portion 51 and a pair of elongate arms 54 extending forwards from lateral sides of the primary portion 51. The primary portion 51 defines a pair of openings 512 on a top and a bottom surface thereof, the openings 512 are defined neighboring to a middle area of the primary portion 51, and divides the primary portion 51 into two segments. A plurality of grooves 521 are defined on a top surface and a bottom surface of the extension portion 52, for receiving the tail portions 25 of the contacts 2, and there are six grooves 521 defined on the top surface and the bottom surface respectively, and the six grooves 521 on the same surface are equally divided into two groups by the opening 512. The protrusions 53 have a top plane coplanar to an upper surface of the primary portion 51, and a bottom plane of the protrusions 53 is coplanar to a lower surface of the primary portion 51. Each protrusion 53 comprises a plurality of gateways (not shown) recessed from a front end thereof along a front-to-back direction, and the gateways are defined in a vertical direction. Each elongate arm 54 defines a tuber 541 on a front end thereof for assorting with the corresponding lateral wall 112 of the insulative housing 1. A block 55 is disposed on a front end of the spacer 5, and located between the pair of protrusions 53, the block 55 has a small size.

In assembly, the contacts 2 are inserted into the insulative housing 1 along a back-to-front direction, the first contacts 21 and the second contacts 22 are accommodated in the first passages 1213 of the first tongue 121 and the second passages 122 of the second tongue 122 respectively, the latches 4 are inserted into the channels 1214 of the first tongue 121. The tail portions 25 of the contacts 2 are exposed beyond the insulative housing 1. Then the spacer 5 is assembled to a back end of the insulative housing 1 along the back-to-front direction, the elongate arms 54 on both sides of the spacer 5 are sliding in the first slots 1121 of the insulative housing 1, until the tubers 541 of the elongate arms 54 locked in the second slots 1122. The protrusions 53 of the spacer 5 are accommodated in the corresponding outlets 114 of the insulative housing 1, to prevent the spacer 5 moving relative to the insulative housing along a transverse direction. The block 55 of the spacer 5 is interferentially cooperated with an indentation (not labeled) on the back end of the insulative housing 1. The pair of tabs 113 of the insulative housing 1 are inserted into the corresponding openings 512 of the spacer 5. A pair of matching holes 115 are formed on a conjunction area between a front end of the bottom plane of the spacer 5 and the back end of the housing 1.

The contacts 2 are inserted into the gateways of the spacer 5 respectively, and the tail portions 25 are exposed in the grooves 521 of the extension portion 52. The cable (not shown) is soldered to corresponding tail portions 25 of the first and second contacts 21, 22.

Then the insulative housing 1 is assembled into the front shell 31, the tongue portion 12 of the insualtive housing 1 is received in the sleeve portion 311 of the front shell 31, the first tongue 121 and the second tongue 122 are received in the mating cavities 3113 respectively. The two mating cavities 3113 can prevent the first and second front segment 1212, 1222 swaying. The engaging arms 42 of the latches 4 are received in the notches 3114 and exposed out of the front shell 31. The conjoining wall 314 of the front shell 31 is abutting against to a front end of the base portion 11 of the insulative housing 1, and the extrusion portion 3116 of the front shell 31 is inserted into the positioning hole 117 of the insulative housing 1, the stopping portions 3115 are abutting against to the vertical wall 116 of the insulative housing 1. The elastic portions 3124 on the shielding member 31 are locked in the corresponding matching holes 115 formed by the spacer 5 and the insulative housing 1.

Then the aforementioned components are assembled into the rear shell 32, the main body 321 of the rear shell 32 is enclosing the engaging portion 312 of the front shell 31, the upper flanges 3215 of the rear shell 32 are located in front of and abutting against to the stopping portions 3115 of the front shell 31. The lower flanges 3216 of the rear shell 32 are located in front of and abutting against to the conjoining wall 314 of the front shell 31, so the rear shell 32 is enclosing the engaging portion 312 of the front shell 31. The fasteners 3214 on both sides of the rear shell 32 are locked into the locking holes 3123 of the front shell 31, the arm portions 313 of the front shell 31 are inserted into the latching holes 3212 of the rear shell 32. The shielding portions 324 of the rear shell 32 are bent towards each other conveniently as there are a number of through holes 325. The continued portion 322 of the rear shell 32 is pressing on an outer jacket of the cable, free ends of the clipping portions 3232 are bent towards each other to enclose the cable and pressing on the continued portion 322, and the two free ends are adjacent to the cutouts 3221 of the continued portion 322.

The front shell 31 is assembled into the rear shell 32 to enclose the insulative housing 1 and an electrical connection between the contacts 2 and the cable. Thus, the cable connector assembly 100 is assembled.

The cable connector assembly 100 is compatible to standard USB 2.0 connector. The size of the first tongue 121 and the arrangement of the first contacts 21 are in accordance with USB 2.0 plug connector standard.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly comprising:

an insulative housing including a base portion and a first tongue and a second tongue extending forwardly from the base portion;

a plurality of contacts received in the insulative housing and held in the first tongue and the second tongue; and a metallic shell enclosing the insulative housing;

wherein the metallic shell comprises a front shell and a rear shell combined with each other, the front shell has a front sleeve portion, a rear engaging portion extending backwards from the sleeve portion, and a pair of arm portions extending rearwards from two sides of the engaging portion and opposite to each other, the rear shell encloses the engaging portion of the front shell, and the rear shell has a latching hole on each of two lateral walls thereof engaging with a corresponding arm portion.

2. The cable connector assembly as claimed in claim 1, wherein each arm portion comprises a straight portion extending along a mating direction and an expansion portion extending backwards and outwards from the straight portion.

3. The cable connector assembly as claimed in claim 1, wherein the engaging portion of the front shell has a locking hole on each of two side walls thereof, the rear shell has a fastener on each side in front of a corresponding latching hole, and the fasteners are locked into corresponding locking holes.

4. The cable connector assembly as claimed in claim 1, wherein a vertical wall is arranged on a conjunction area between the base portion and the first and second tongues, and a positioning hole is recessed backwards from the vertical wall.

5. The cable connector assembly as claimed in claim 4, wherein a horizontal extrusion portion extends backwards from a back end of the sleeve portion and is inserted into the positioning hole of the insulative housing.

6. The cable connector assembly as claimed in claim 4, wherein the positioning hole is located on one side of the vertical wall.

7. The cable connector assembly as claimed in claim 4, wherein the vertical wall is recessed backwards.

8. The cable connector assembly as claimed in claim 1, wherein the sleeve portion defines a pair of stopping portions bent upwards from a back free end thereof, and the stopping portions are located on a boundary between the sleeve portion and the engaging portion and arranged along a vertical direction.

9. The cable connector assembly as claimed in claim 8, wherein a vertical conjoining wall is defined on a conjunction area between the engaging portion and the sleeve portion, the rear shell defines a pair of upper flanges and a pair of lower flanges on a front end thereof.

10. The cable connector assembly as claimed in claim 9, wherein the upper flanges are located in front of and abut against the stopping portions, and the lower flanges are located in front of and abut against the conjoining wall.

11. The cable connector assembly as claimed in claim 8, wherein a vertical wall is arranged on a conjunction area between the base portion and the first and second tongues, and the stopping portions abut against the vertical wall.

12. The cable connector assembly as claimed in claim 1, wherein the rear shell has a main body and a pair of shielding portions extending rearwards from lateral sides of the main body, and the shielding portions are bent towards each other to shield a back end of the rear shell.

13. The cable connector assembly as claimed in claim 12, wherein a plurality of through holes are disposed on a conjunction area of each shielding portion and the main body, and the through holes on a same side are arranged along a vertical direction.

14. The cable connector assembly as claimed in claim 1, wherein the rear shell defines a continued portion extending backwards from an upper surface thereof and a fixing portion opposite to the continued portion, the fixing portion has a clipping portion extending along a transverse direction on a free end thereof.

15. A cable connector assembly comprising:

an insulative housing defining a base portion and a tongue portion extending forwardly therefrom in a front-to-back direction;

a plurality of contacts disposed in the housing with contacting sections exposed upon the tongue portion;

a metallic shell device enclosing the housing and defining a front shell and a rear shell assembled to each other, said front shell defining a front sleeve portion enclosing the tongue portion and a rear engaging portion enclosing the base portion, and said rear shell defining a tubular main body enclosing the rear engaging portion, the rear engaging portion defining at least a pair of front side walls and the main body defining a pair of rear side walls; and an interengaging mechanism including a recessed structure and a protruding structure; wherein the pair of front side walls includes one of said recessed structure and said protruding structure, while the pair of rear side walls includes the other of the recessed structure and the protruding structure to engage with said one of the recessed structure and said protruding structure so as to prevent relative movement between the front shell and the rear shell in the front-to-back direction.

16. The cable connector assembly as claimed in claim 15, wherein said engaging portion is of a U-shaped structure including said pair of front side walls.

17. The cable connector assembly as claimed in claim 15, further including another interegaging mechanism defining another recessed structure and another protruding structure respectively formed on one and the other of the front side walls and the rear side walls for engage each other.

18. The cable connector assembly as claimed in claim 17, wherein the pair of front side walls is equipped with the one recessed structure and the one protruding structure, and the pair of rear side walls is equipped with another one recessed structure and another one protruding structure for engagement with the one protruding structure and the one recessed structure.

19. The cable connector assembly as claimed in claim 18, wherein the protruding structure on the pair of rear side walls extends inwardly while the protruding structure on the pair of front side walls extends outwardly.

20. The cable connector assembly as claimed in claim 15, wherein the rear shell is equipped with flanges on a front edge to narrow a front opening through which the sleeve portion of the front shell extends forwardly.

* * * * *